United States Patent [19]

Claycomb

[11] Patent Number: 4,915,177

[45] Date of Patent: Apr. 10, 1990

[54] BLAST JOINT FOR SNUBBING INSTALLATION

[76] Inventor: Jack R. Claycomb, 8226 Waynemer, Houston, Tex. 77040

[21] Appl. No.: 382,898

[22] Filed: Jul. 19, 1989

[51] Int. Cl.[4] ..... E21B 17/10; F16L 55/00

[52] U.S. Cl. ..... 166/380; 138/147; 138/155; 166/237; 166/243; 285/45; 285/100; 285/323; 285/333

[58] Field of Search ..... 166/206, 208, 217, 134, 166/243, 380, 237; 285/144, 147, 139, 138, 45, 323, 333, 100, 341; 138/147, 155; 29/455.1

[56] References Cited

U.S. PATENT DOCUMENTS

| | | | |
|---|---|---|---|
| 1,855,350 | 4/1932 | Humason | 285/144 |
| 3,233,926 | 2/1966 | Waltersheid-Muller | 285/341 |
| 3,598,429 | 6/1971 | Arnold | 285/322 X |
| 4,028,796 | 6/1977 | Bergstrom | 166/243 X |
| 4,141,386 | 2/1979 | Bergstrom | 166/243 X |
| 4,211,440 | 7/1980 | Bergstrom | 166/243 X |
| 4,349,050 | 9/1982 | Bergstrom et al. | 166/243 X |
| 4,613,165 | 9/1986 | Kuhne | 166/243 X |
| 4,635,968 | 1/1987 | Kuhne | 166/243 X |
| 4,685,518 | 8/1987 | Claycomb | 166/243 |
| 4,726,423 | 2/1988 | Claycomb | 166/243 |

FOREIGN PATENT DOCUMENTS

| | | | |
|---|---|---|---|
| 406205 | 3/1946 | Italy | 285/323 |

*Primary Examiner*—Stephen J. Novosad

*Attorney, Agent, or Firm*—Pravel, Gambrell, Hewitt, Kimball & Krieger

[57] ABSTRACT

A blast joint and related handling apparatus and method for installing the blast joint in a pressurized well, using a snubber unit. The blast joint has a pressure rated protective jacket, a pressure operated ring load compensator, and an adjustable tubing anchor.

14 Claims, 9 Drawing Sheets

BLAST JOINT FOR SNUBBING INSTALLATION

FIELD OF THE INVENTION

This invention is in the field of blast joints used as sections of production tubing in oil and gas wells to protect the tubing against erosion by impingement of high pressure fluids. In particular, this invention is in the field of blast joints which can be inserted into a well through a snubber unit.

BACKGROUND

In the drilling and operation of an oil or gas well, it is frequently necessary to have the production tubing penetrate a layer of a formation which contains high pressure gases or other fluids. This occurs when the desired production layer is below the aforementioned layer containing the high pressure fluids. In such a case, the desired product is brought to the surface through production tubing which must successfully withstand the environment found in the intervening high pressure layer. This environment frequently includes the impingement of high pressure jets of fluid on the outer surface of the production tubing. The high pressure fluid can also contain entrained particulate matter which can be highly abrasive, such as sand.

Operators commonly use sections of production tubing called blast joints to penetrate these layers, because the blast joints are less susceptible to erosion damage than common steel production tubing. A common method of limiting susceptibility to erosion damage is to incorporate into the blast joint a stack of erosion-resistant rings made of such materials as tungsten carbide. This stack of rings is arranged continuously along the outside surface of the production tube to protect it, because the tungsten carbide can resist impingement of abrasives at very high pressures and velocities.

One disadvantage of using carbide rings is that they tend to be very brittle, and they are therefore very susceptible to surface disintegration or even breakage if placed under concentrated mechanical loads such as those imposed by pipe slips or power tongs. This disadvantage is especially serious when the operator wishes to insert the blast joint through a snubber unit.

A snubber unit is mounted on the wellhead of a well which is to be reworked under pressure. Use of the snubber unit allows reworking of a pressurized well without first plugging or killing the well. Killing the well is undesirable because it can be difficult and expensive to resume production from a well that has been killed. A snubber unit establishes and maintains a pressure seal around the tubular goods coming out of or going into the well at the wellhead. It is typically mounted atop one or more blow-out-preventers. In addition to maintaining the pressure seal, the snubber unit grips any tubular goods being inserted and forces them into the well against the wellhead pressure, which can approach several thousand pounds per square inch. Alternatively, the snubber unit can be used to grip a tubular good being extracted from the well to limit or control its outward movement under wellhead pressure.

This gripping of the tubular goods can be accomplished by pipe slips or other devices which place highly concentrated mechanical loads on the goods being gripped. In addition, the pressure seal can only be effective if applied to a relatively smooth surface which is capable of maintaining its pressure integrity under the pressures experienced at the wellhead. It can be seen, then, that a typical carbide blast joint can not be inserted into a well with a snubber unit. If this were attempted, the carbide rings would immediately deteriorate or even fail completely, and the pressure seal could not be maintained. A very expensive and dangerous blowout would occur. For this reason, whenever it has been necessary to insert a blast joint during rework of a well, the well has been killed, rather than using a snubber unit. It would be highly advantageous to design a carbide blast joint which can be used with a snubber installation.

SUMMARY OF THE INVENTION

In one aspect, this invention is a blast joint system, including the blast joint itself and the handling gear necessary to assemble the joint in the desired length while incrementally inserting the joint into a well with a snubber unit.

In another aspect, this invention is a method of assembling a blast joint while incrementally inserting the joint into a well with a snubber unit, which can only be practiced with the apparatus described.

In another aspect, this invention is a load compensator which maintains zero clearance between carbide rings as the blast joint is snubbed into a pressurized well and subjected to well pressures and temperatures, by taking advantage of the well pressure to operate the load compensator.

In another aspect, this invention is a tubing anchor having two cone cylinders threaded together with pipe slips in between, such that conical surfaces on the cylinders mate with conical surfaces on the pipe slips to drive the slips the production tube wall.

DETAILED DESCRIPTION OF THE INVENTION

Figure 6:
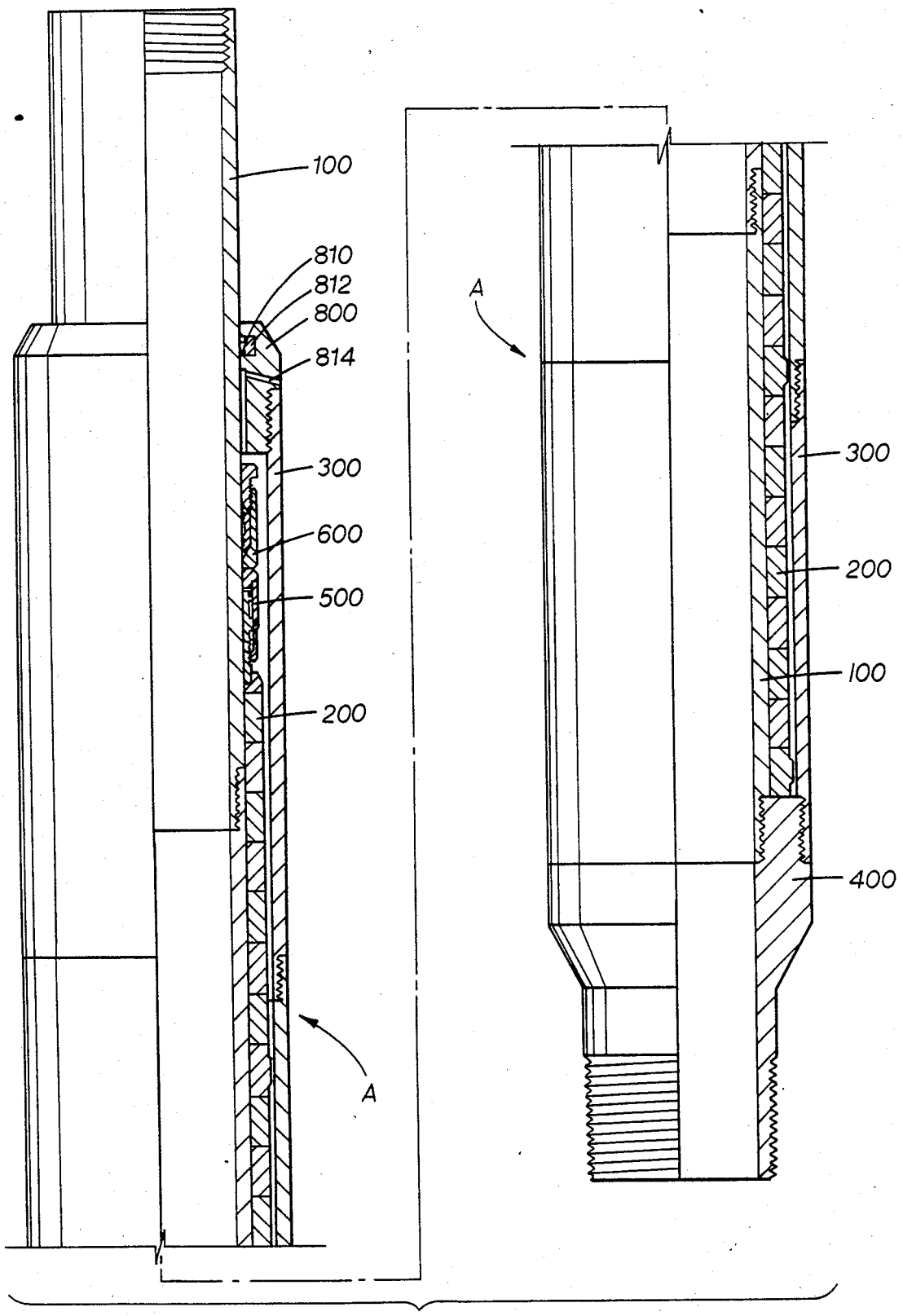
FIG. 6 is a partial sectional view of the apparatus of the invention as fully assembled onto production tubing, without its handling gear.

This invention is a uniquely designed blast joint and a method and apparatus for inserting that blast joint into a pressurized well through a snubber unit. The blast joint as it looks after being inserted is shown in FIG. 6. Blast joint A has multiple sections of production tubing 100 surrounded by a stack of carbide rings 200, which are in turn surrounded by multiple sections of a pressure jacket 300. The lowermost length of production tubing 100 and the lowermost length of pressure jacket 300 are threaded to concentric sub 400 which is in turn threaded to production tubing B which was originally installed in the well. Blast joint A is assembled and snubbed into the well in sections to result in a blast joint of the desired length.

After the desired length of blast joint has been assembled and inserted into the well, the final section is assembled thereto and inserted, and additional production tubing is run above the blast joint. In the final section of the blast joint A, hydrostatic load compensator 500 sits atop the uppermost carbide ring 200, and tubing anchor 600 sits atop the hydrostatic load compensator 500, fastened securely to the final section of production tube 100. Hydrostatic load compensator 500 expands under the influence of well pressure to maintain a load on the carbide rings 200, preventing any slack space therebetween as production tube 100 expands faster than carbide rings 200 when a thermal gradient is experienced.

Figure 1:
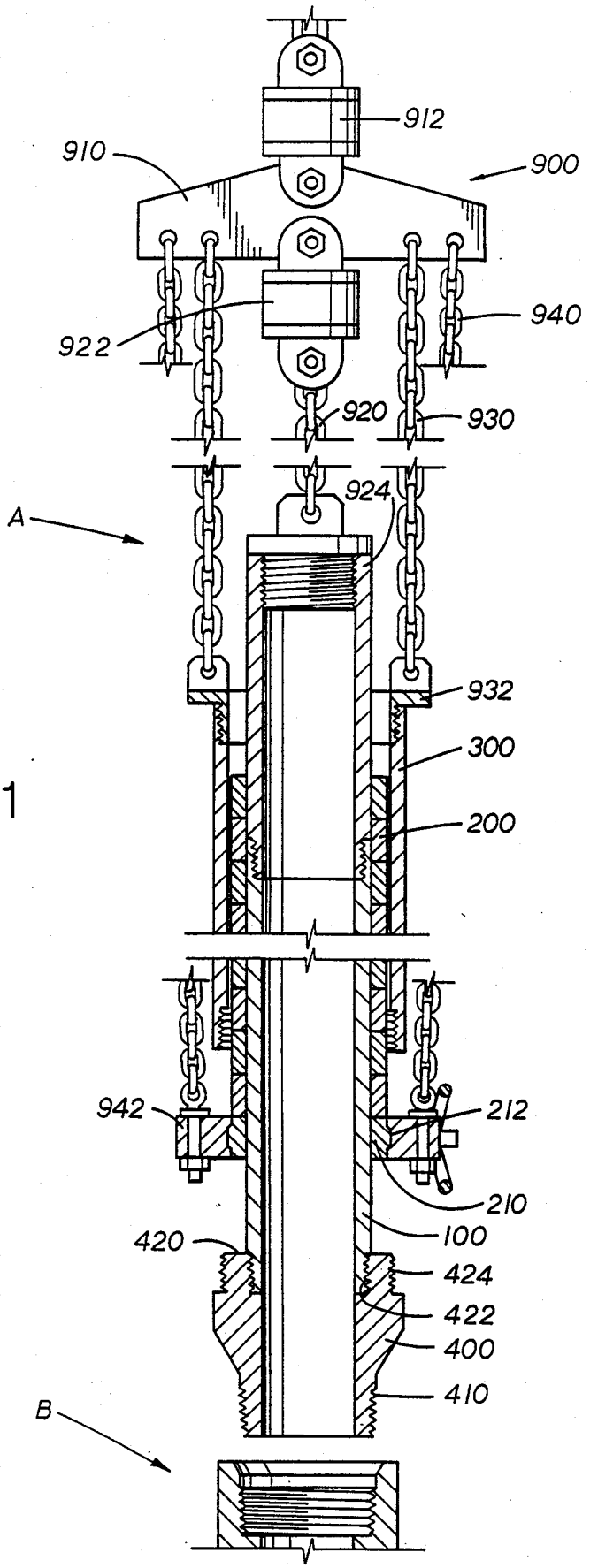
FIG. 1 is a sectional view of a first length of the apparatus of the invention suspended over a well.
Figure 5:
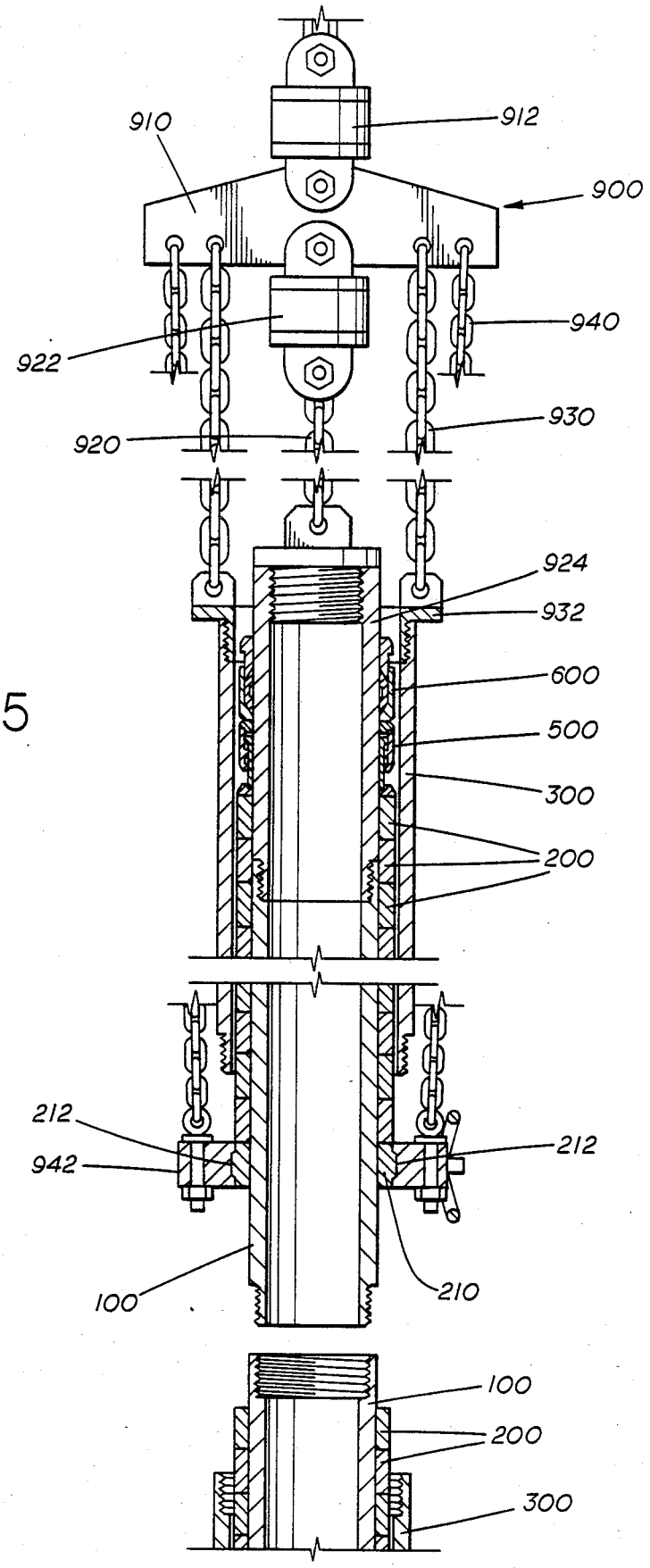
FIG. 5 is a sectional view of a final length of the apparatus of the invention suspended over the next lowermost length.

As shown in FIG. 1, through 5, concentric sub 400 has lower threads 410 which can thread into matching threads on production tubing B which protrudes from the well through the snubber unit (not shown). The upper end 420 of concentric sub 400 has internal threads 422 into which production tube 100 threads and external threads 424 onto which pressure jacket 300 can thread to create a pressure barrier between well pressure outside pressure jacket 300 and ambient pressure inside pressure jacket 300 during insertion into the well. The upper end 420 of concentric sub 400 also provides a resting place upon which the lowermost carbide ring 200 will rest eventually.

As mentioned, blast joint A is assembled in sections or lengths and then hoisted vertically to be installed on the preceding section at the snubber unit. Each length of blast joint A has a length of production tube 100, a set of carbide rings 200, and a length of pressure jacket 300. The lowermost carbide ring 210 of each set of rings 200 has a section of increased outer diameter 212 to facilitate clamping with circumferential clamps 942.

The first section of blast joint A to be installed can be assembled as shown in FIG. 1 with concentric sub 400 on the end of production tube 100, or concentric sub 400 can be first installed on the tubing protruding from the snubber. Intermediate sections of blast joint A are, of course, assembled as shown in FIG. 5 without concentric subs. The last, or uppermost section of blast joint A as shown in FIG. 6 has hydrostatic load compensator 500 installed above the uppermost carbide ring 200, and above that is tubing anchor 600. At the very top of blast joint A is top guide 800 which is threaded to the top of the uppermost length of pressure jacket 300. As seen in FIG. 6, top guide 800 has internal annular groove 810 in which elastomeric sand baffle 812 is located. Pressure equalization channel 814 allows well pressure to slowly enter the pressure jacket 300 after the blast joint A is entirely snubbed into the well. It can be preferable to angle channel 814 downwardly as shown to minimize contamination with sand or other matter.

Figure 7:
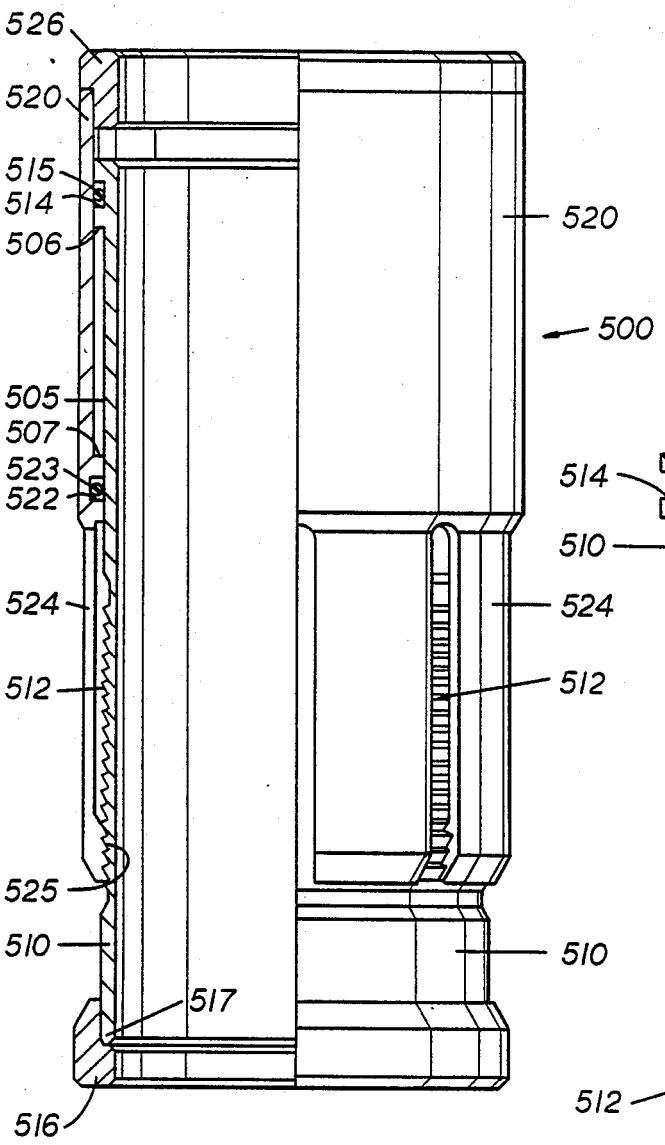
FIG. 7 is a partial sectional view of the hydrostatic load compensator of the invention.
Figure 8:
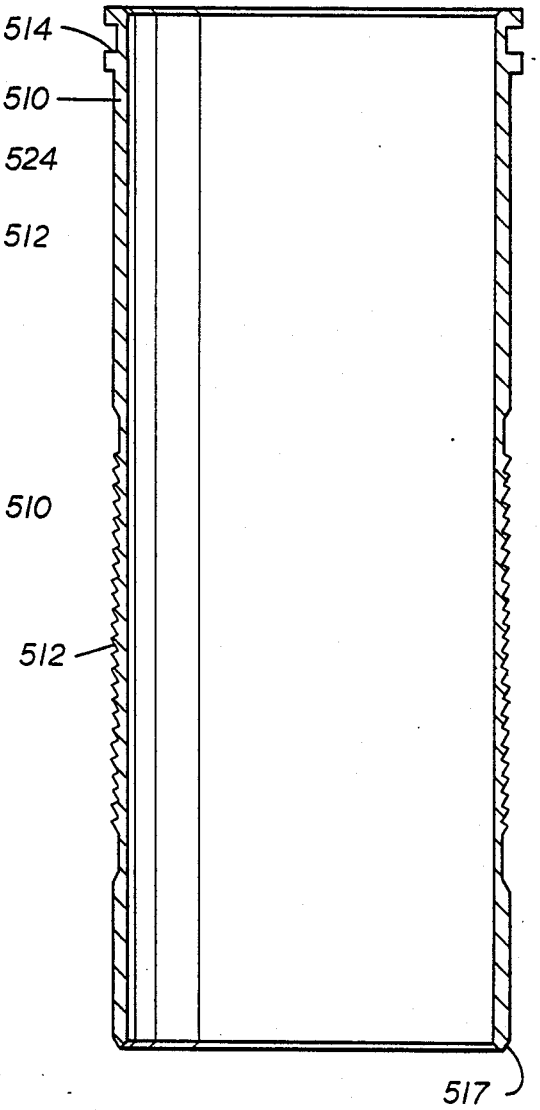
FIG 8 is a sectional view of the ratchet sleeve of the hydrostatic load compensator.
Figure 9:
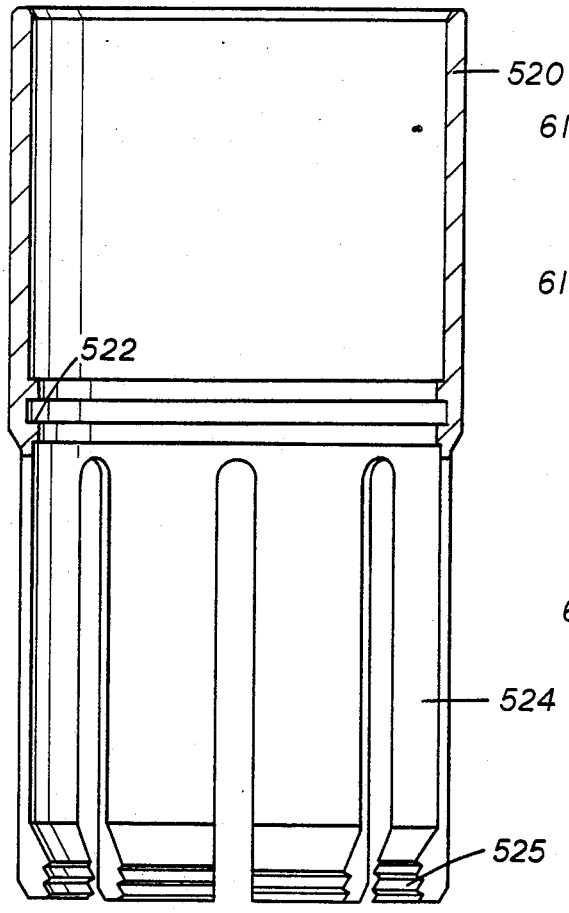
FIG. 9 is a sectional view of the pawl sleeve of the hydrostatic load compensator.
Figure 11:
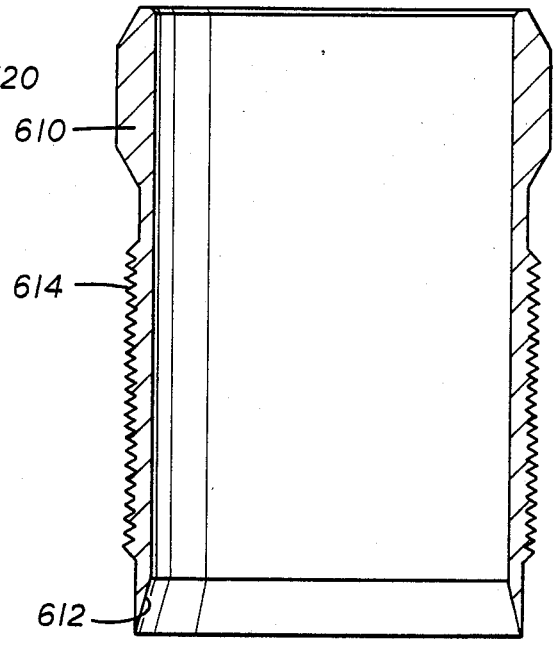
FIG. 11 is a sectional view of the inner cone cylinder of the tubing anchor of the invention.
Figure 13:
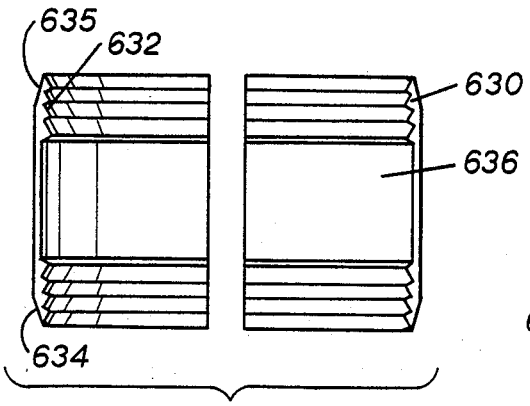
FIG. 13 is a sectional view of the slip segments of the tubing anchor of the invention.
Figure 12:
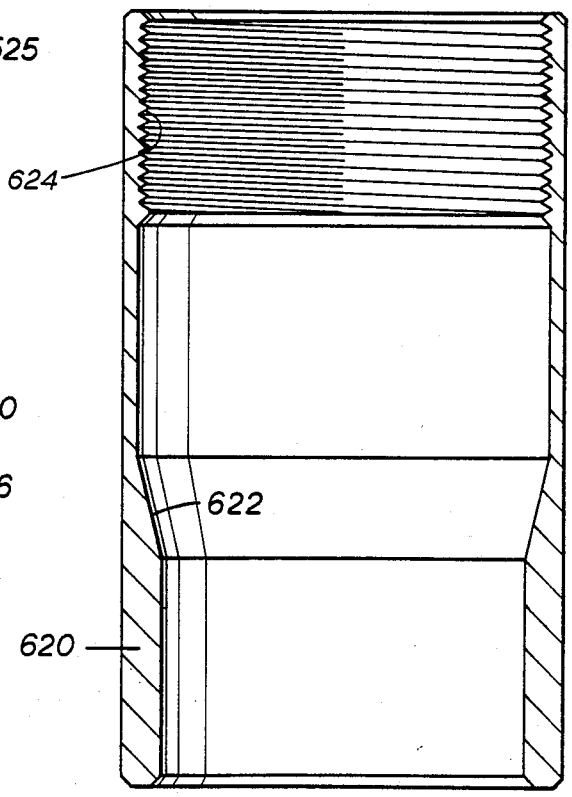
FIG. 12 is a sectional view of the outer cone cylinder of the tubing anchor of the invention.
Figure 10:
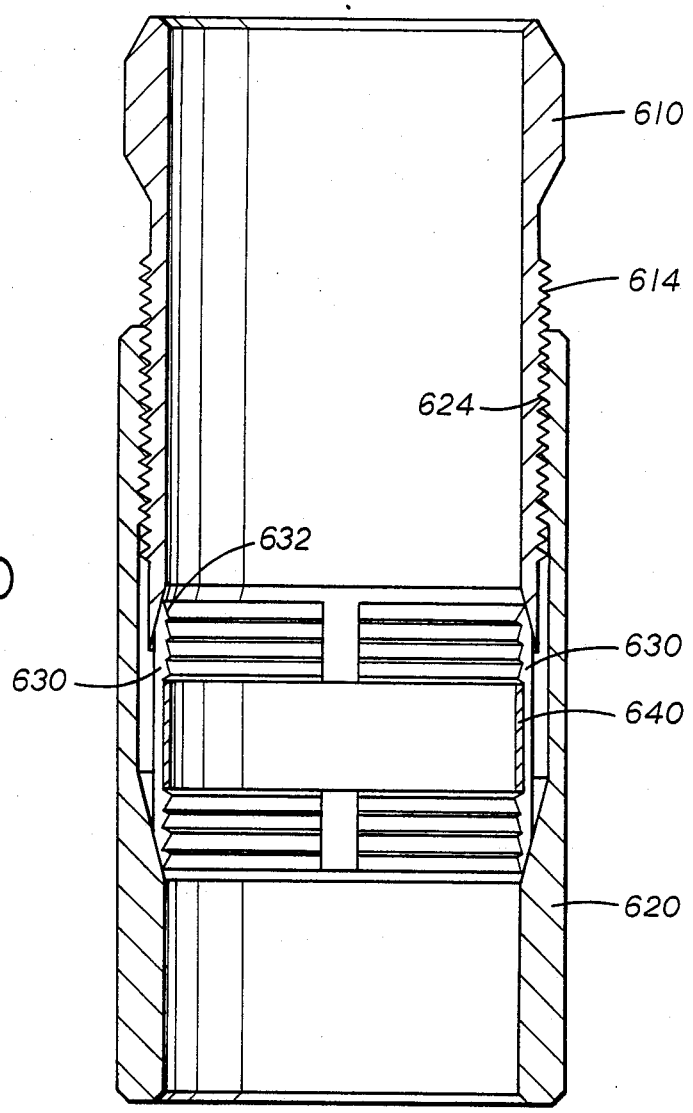
FIG. 10 is a sectional view of the tubing anchor of the invention.
Figure 14:
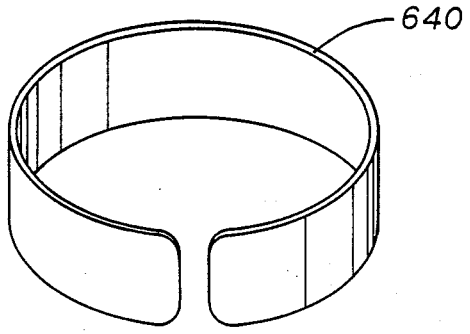
FIG. 14 is a sectional view of the circular spring of the tubing anchor of the invention.

Two items important to the operation of blast joint A are hydrostatic load compensator 500 and tubing anchor 600. As seen in FIGS. 7, 8 and 9, hydrostatic load compensator 500 is composed of ratchet sleeve 510 and pawl sleeve 520. Ratchet sleeve 510 is sized to fit the outer diameter of production tube 100 in a slip fit. On the outer surface of ratchet sleeve 510 are threads 512 which have a shallow angle on one face and a steeper angle on the other face. Near one end of ratchet sleeve 510 is outer seal groove 514 which contains seal 515. The other end of ratchet sleeve 510 can have adaptor ring 516 to provide a larger load bearing shoulder to press against carbide rings 200.

Pawl sleeve 520 has intermediate inner seal groove 522 which contains seal 523. Extending from one end of pawl sleeve 520 are ratchet pawls 524 which are flexible fingers having pawl teeth 525 on their radially inward surfaces. Pawl teeth 525 have one shallow angled face and one steep angled face to match the faces of ratchet threads 512. Pawl teeth 525 can ratchet along ratchet threads 512 as ratchet sleeve 510 and pawl sleeve 520 move in relative axial motion. Alternatively, because pawl teeth 525 and ratchet threads 512 are cut as threads, sleeves 510 and 520 can be threaded together or apart. The angles of the faces of pawl teeth 525 and ratchet threads 512 are selected to permit the sleeves to ratchet apart axially from the position shown in FIG. 7 more easily than they ratchet together. Pawls 524 can spring outwardly to clear shoulder 517 on the end of ratchet sleeve 510 as the sleeves 510, 520 are first assembled, with ratchet sleeve 510 being inserted into pawl sleeve 520 with shoulder 517 going first. Assembling sleeves 510, 520 together forms annular chamber 505 between seals 515, 523. Annular chamber 505 is at atmospheric pressure. Pawl sleeve 520 can have on its end opposite pawls 524 adaptor ring 526 to provide a larger load bearing shoulder to press against tubing anchor 600.

As blast joint A is inserted into the well, the pressure around hydrostatic load compensator 500 increases to well pressure while the pressure inside chamber 505 remains essentially at ambient. Well pressure acts on the exposed end surfaces of annular chamber 505, decreasing the size of annular chamber 505 by moving seal grooves 514 and 522 toward each other and simultaneously increasing the overall length of hydrostatic load compensator 500. This sliding apart of sleeves 510, 520 occurs because the well pressure acting on the outside end surfaces of annular chamber 505 multiplied by the effective area of those surfaces is greater than the ambient pressure found inside annular chamber 505 multiplied by the area of the inside end surfaces 506, 507 of annular chamber 505. The pressure inside annular chamber 505 can increase slightly because of the reduction in volume of chamber 505 and because of the increase in temperature, but it will never approach the well pressure, which can be several thousand pounds.

The increased length of hydrostatic load compensator 500 prevents any slack between carbide rings as the production tube 100 expands. The thicknesses of sleeves 510, 520 are calculated to provide the desired forces necessary to load carbide rings 200 properly, in view of the well pressures anticipated, without imposing enough force to damage the rings 200.

As seen in FIGS. 10 through 14, tubing anchor 600 has inner cone cylinder 610, outer cone cylinder 620, slip segments 630, and circular leaf spring 640. Inner cone cylinder 610 has on its inner surface near one end frusto-conical face 612, and threads 614 on its outer surface. Outer cone cylinder 620 has on its inner surface frusto-conical face 622, and threads 622 on its inner surface aligned with threads 614. Positioned between cone cylinders 610, 620 are slip segments 630 arranged symmetrically around the circumference of production tube 100. Slip segments 630 have slip teeth 632 on their inner surfaces toward production tube 100. Frusto-conical faces 634, 635 on slip segments 630 mate with faces 622, 612, respectively.

Circular leaf spring 640 lies in circumferential channel 636 inside slip segments 630 and biases slip segments 630 outwardly. As cone cylinders 610, 620 are threaded together, faces 612, 622 press against faces 635, 634 to drive slip segments 630 radially inwardly to grip production tube 100, anchoring tubing anchor 600 against movement.

Assembly and insertion of blast joint A will now be described. The first, or lowermost length of blast joint A is assembled as described before, with concentric sub 400, the first length of production tube 100, the first set of carbide rings 200, and the first length of pressure jacket 300. These components are suspended from a crane or other lifting device as shown in FIG. 1 by means of suspension and swivel assembly 900. At the top of assembly 900 is swivel block 910, which swivels about swivel 912. Suspended from swivel block 910 are suspension chains 920, 930, 940. Chain 920 hangs from swivel 922, supporting tubing adaptor collar 924 and production tube 100. Chains 930 hang directly from swivel block 910, supporting pressure jacket adapter ring 932 and pressure jacket 300. Chains 940 hang directly from swivel block 910, supporting circumferential clamp 942 and carbide rings 200.

Figure 2:
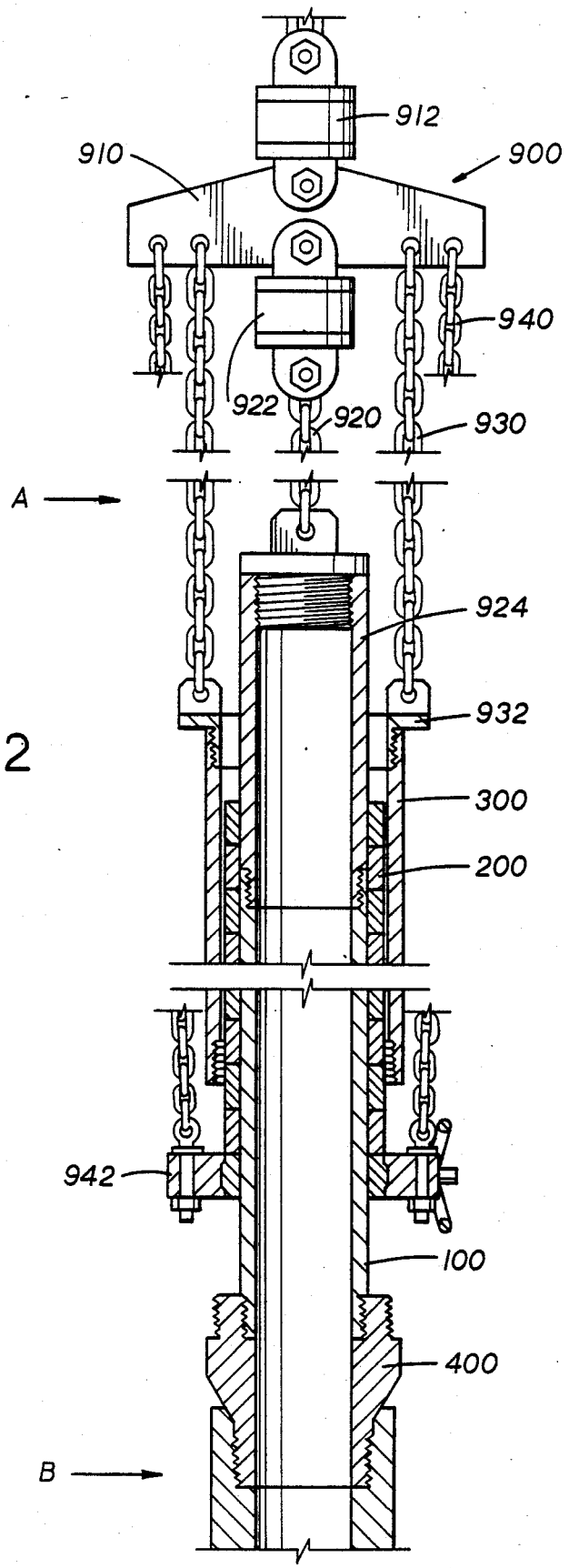
FIG. 2 is a sectional view of the apparatus of FIG. 1 after attachment of the production tube to existing tubing extending from the well.
Figure 3:
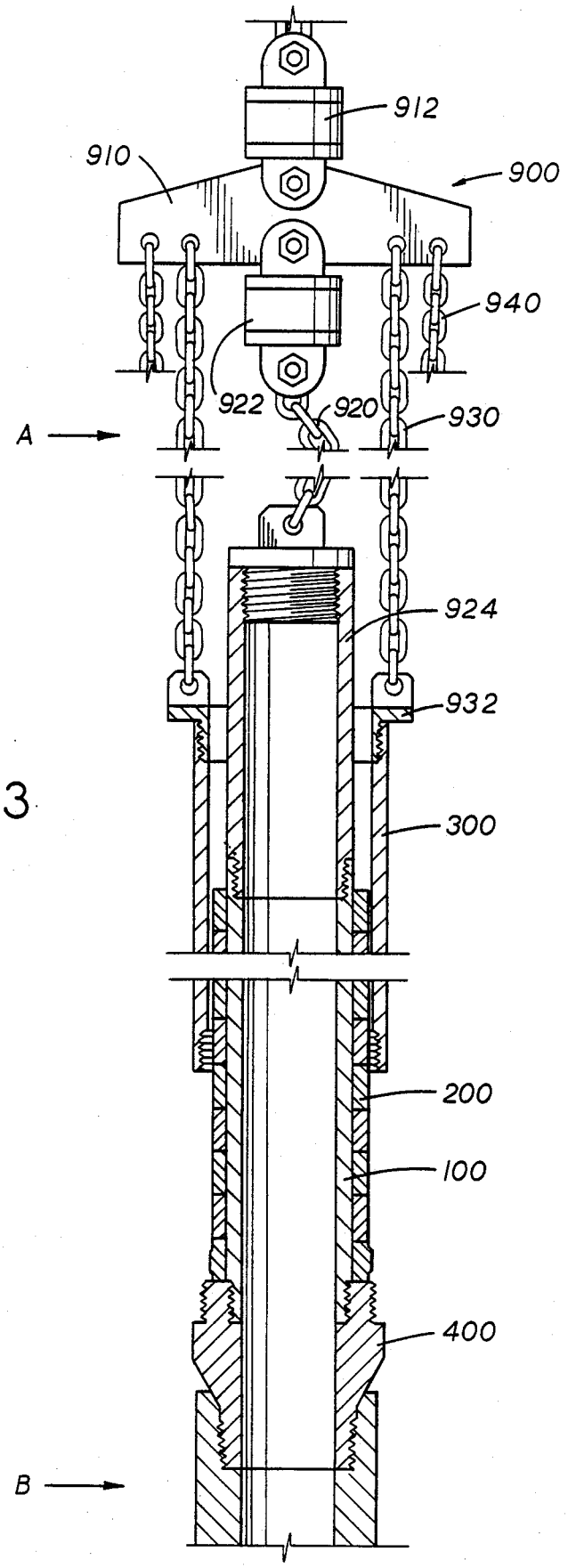
FIG. 3 is a sectional view of the apparatus of FIG. 1 after lowering of the erosion-resistant rings.
Figure 4:
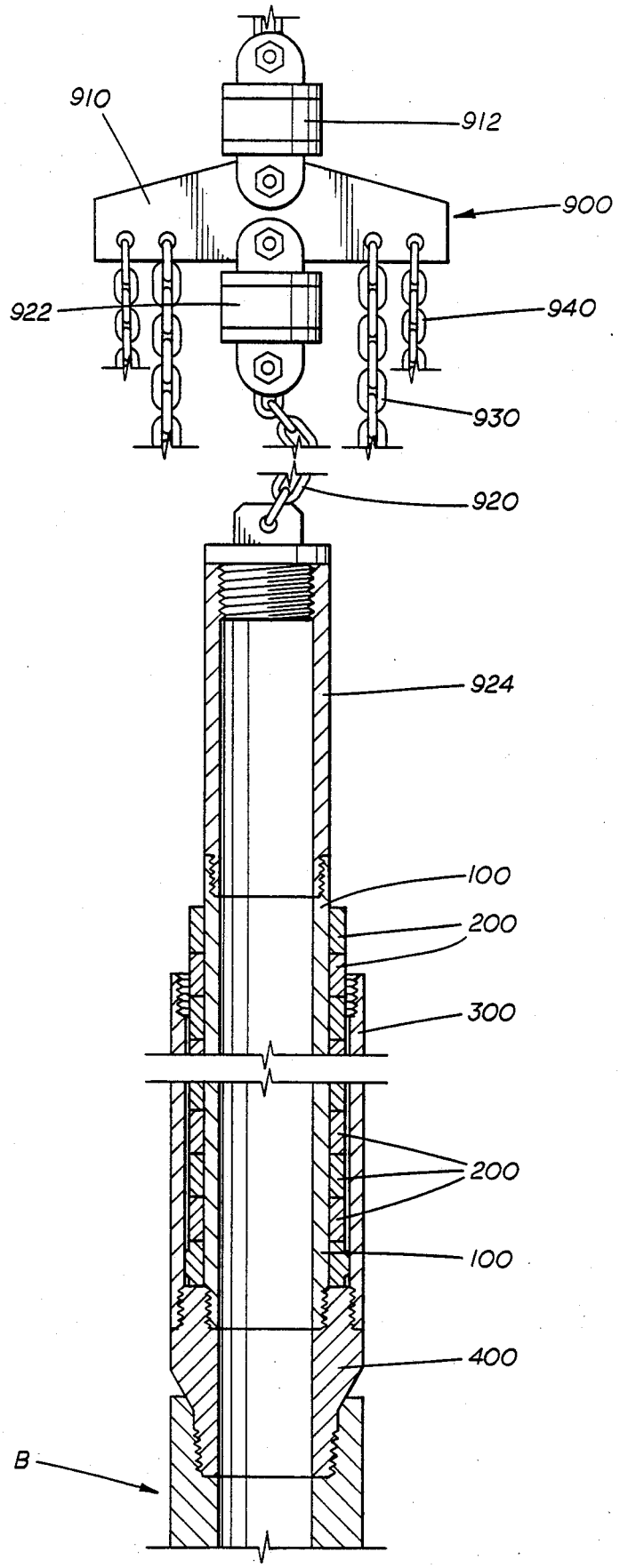
FIG. 4 is a sectional view of the apparatus of FIG. 1 after lowering of the pressure jacket.

This section of blast joint A is lowered onto existing production tubing B until production tube 100 or concentric sub 400 can be threaded in place as shown in FIG. 2. Swivel block 910 is then lowered further until carbide rings 200 rest on concentric sub 400, and clamp 942 is released as shown in FIG. 3. Then, swivel block 910 is lowered further until pressure jacket 300 can be threaded onto concentric sub 900 as shown in FIG. 4. The lengths of chains 920, 930, 940 are chosen so that when hoisted, the lower end of production tube 100 is exposed by about a foot below the carbide rings 200 to allow working access. Pressure jacket 300 is similarly about a foot above the lower end of carbide rings 200. In practice, a thread protector (not shown) can be screwed onto production tube 100, and a spacer pipe (not shown) can be held on the outer surface of the lower end of production tube 100 by the thread protector to insure adequate working space below carbide rings 200. The thread protector and spacer pipe are, of course, removed prior to making up the production tube. Tubing adaptor collar 924 can be of a length selected to allow the aforementioned raising of carbide rings 200 and pressure jacket 300 while ensuring the desired constant relative alignment, as installed, of the upper ends of the respective lengths of production tube 100 and pressure jacket 300. In other words, substantially equal lengths of production tube 100 and pressure jacket 300 can be used, but the lower end of the production tube 100 will still protrude from the lower end of the stack of carbide rings 200, during lifting and installation.

Successive lengths of blast joint A are assembled and hoisted, as shown in FIG. 5, made up with preceding lengths and snubbed into the well. As each length or section is snubbed into the well, its length of pressure jacket 300 protects the carbide rings 200 from mechanical damage and seals the well pressure on its outside surface from the ambient pressure on its inside surface. The tubing used for pressure jacket 300 should have an external pressure rating suitable for the well pressure to be encountered, with a typical rating being 10,000 pounds per square inch of outside pressure.

The last length of blast joint A to be installed has hydrostatic load compensator 500 and tubing anchor 600 slipped onto production tube 100 atop the uppermost carbide ring 200. Just before the final length of pressure jacket 300 is lowered and threaded into place, tubing anchor 600 is set tightly against production tube 100. Any resulting slack from setting anchor 600, which should be a small amount, is taken out by threading ratchet sleeve 510 and pawl sleeve 520 apart slightly.

Then, the final length of pressure jacket 300 is lowered and threaded into place. Top guide 800 is then installed and threaded into place. Finally the final length of blast joint A is snubbed into the well.

The embodiment described here is intended to be illustrative only. Variations on this embodiment will be apparent to one skilled in the art. All such variations are intended to be encompassed by the following claims.

I claim:

1. A blast joint apparatus for insertion into a well through a snubber unit, comprising:

a production tube;

a concentric sub attached to a lower end of the production tube, threaded for connection to production tubing in the well;

erosion resistant rings on the outer surface of the production tube, stacked upwardly from the concentric sub;

a pressure jacket attached at a lower end thereof to the concentric sub and extending upwardly along the production tube outside the erosion resistant rings;

first support means attached to an upper end of the production tube, to support the production tube;

second support means attached to an upper end of the pressure jacket, to support the pressure jacket;

third support means attached to the erosion resistant rings, to support the erosion resistant rings;

anchor means for preventing relative vertical movement between the erosion resistant rings and the production tube; and load compensating means for maintaining a vertical load on the erosion resistant rings to prevent separations between rings.

2. The blast joint apparatus of claim 1, wherein the first support means comprises:

a collar threadedly attached to the upper end of the production tube;

first suspension means attached to the collar for suspending the production tube from above;

first swivel means attached to the first suspension means for allowing the production tube to swivel about a vertical axis while suspended; and lifting means attached to the first swivel means from which the first suspension means can suspend the production tube and which can lift the production tube.

3. The blast joint apparatus of claim 1, wherein the second support means comprises:

an adaptor ring threadedly attached to the upper end of the pressure jacket;

second suspension means attached to the adaptor ring for suspending the pressure jacket from above;

second swivel means attached to the second suspension means for allowing the pressure jacket to swivel about a vertical axis while suspended; and lifting means attached to the second swivel means from which the second suspension means can suspend the pressure jacket and which can lift the pressure jacket.

4. The blast joint apparatus of claim 1, wherein selected erosion resistant rings have enlarged outer diameters to facilitate gripping the selected rings with circumferential clamps.

5. The blast joint apparatus of claim 1, wherein the third support means comprises:

a circumferential clamp for gripping the outer diameter of a selected erosion resistant ring;

third suspension means attached to the circumferential clamp for suspending the erosion resistant rings from above; and lifting means attached to the third suspension means from which the third suspension means can suspend the circumferential clamp and which can lift the circumferential clamp, the erosion resistant ring to which it is attached, and all erosion resistant rings thereabove on the blast joint.

6. The blast joint apparatus of claim 1, wherein the first, second and third support means include a common lifting means for lifting the production tube, the pressure jacket, and the erosion resistant rings.

7. A method for attaching a blast joint to installed production tubing and inserting the blast joint into a well through snubber unit, comprising the steps of:

assembling a first length of a blast joint having a first length of production tube, a concentric sub attached to a lower end of the production tube, a first set of erosion-resistant rings stacked vertically on the outside of the production tube, and a first length of pressure jacket extending vertically outside the erosion-resistant rings;

attaching the first length of blast joint to a lifting means which independently supports the first length of production tube, the first length of pressure jacket, and the first set of erosion-resistant rings, so that the tube, the jacket, and the rings can move vertically independently and swivel independently about a vertical axis;

lifting the first length of blast joint to a vertical position such that a lower end of the first set of erosion resistant rings is above a lower end of the first length of production tube, and a lower end of the first length of pressure jacket is above the lower end of the first set of erosion-resistant rings;

threading the concentric sub into the installed production tubing which protrudes from the snubber unit;

lowering the lifting means until the first set of erosion-resistant rings rests upon the concentric sub;

releasing the erosion-resistant rings from the lifting means;

further lowering the lifting means until the first length of pressure jacket contacts the concentric sub;

threading the first length of pressure jacket onto the concentric sub;

snubbing the first length of blast joint into the well; and releasing the pressure jacket and the production tube from the lifting means.

8. The method of claim 7, further comprising the steps of:

assembling a second length of blast joint having a second length of production tube, a second set of erosion-resistant rings stacked vertically on the outside of the production tube, and a second length of pressure jacket extending vertically outside the erosion-resistant rings;

attaching the second length of blast joint to a lifting means which independently supports the second length of production tube, the second length of pressure jacket, and the second set of erosion-resistant rings, so that the tube, the jacket, and the rings can move vertically independently and swivel independently about a vertical axis;

lifting the second length of blast joint to a vertical position such that a lower end of the second set of erosion-resistant rings is above a lower end of the second length of production tube, and a lower end of the second length of pressure jacket is above the lower end of the second set of erosion-resistant rings;

threading the second length of production tube into the upper end of the first length of production tube;

lowering the lifting means until the second set of erosion-resistant rings rests upon the first set of erosion-resistant rings;

releasing the second set of erosion-resistant rings from the lifting means;

further lowering the lifting means until the second length of pressure jacket contacts the first length of pressure jacket;

threading the second length of pressure jacket into the first length of pressure jacket;

snubbing the second length of blast joint into the well; and releasing the pressure jacket and the production tube from the lifting means.

9. The method of claim 7, further comprising the steps of:

assembling as part of the blast joint a load compensator on the top of the erosion-resistant rings to maintain downward pressure on the rings to prevent separations therebetween, an anchor device on top of the load compensator for anchoring the load compensator against vertical movement relative to the production tube, and a top guide on top of the anchor device, for threading to the pressure jacket;

anchoring the load compensator against the upper end of the erosion-resistant rings; and threading the top guide onto the pressure jacket.

10. The method of claim 7, further comprising the steps of:

attaching a removable extension to the upper end of the production tube, for connection to the lifting means, to allow stacking additional erosion resistant rings on the production tube during assembly of the length of the blast joint; and removing the extension from the production tube to release the production tube from the lifting means.

11. A hydrostatic load compensator for maintaining force on a stack of erosion-resistant rings in a blast joint to prevent separation between the rings, comprising:

a cylindrical ratchet sleeve having circumferential ratchet grooves on the external surface thereof;

a cylindrical pawl sleeve concentric with the ratchet sleeve and radially outward therefrom;

a plurality of pawls extending from an end of the pawl sleeve;

circumferential ratchet grooves on an internal surface of the pawls, meshing with the ratchet grooves on the ratchet sleeve; and a sealed enclosure located between the ratchet sleeve and the pawl sleeve maintained at a relatively low pressure, creating a pressure differential from outside the enclosure to inside the enclosure, to promote axial movement of the ratchet sleeve relative to the pawl sleeve upon increases in the pressure surrounding the load compensator.

12. The hydrostatic load compensator of claim 11, wherein the circumferential ratchet grooves on the ratchet sleeve and the pawl sleeve are matching threads having one face at a relatively shallow angle from the axis of the sleeves and one face at a relatively steep angle from the axis of the sleeves.

13. The hydrostatic load compensator of claim 11, wherein the enclosure maintained at a relatively low pressure comprises:

one wall formed by a portion of the ratchet sleeve;

one wall formed by a portion of the pawl sleeve; and at least one seal between the ratchet sleeve and the pawl sleeve.

14. A tube anchor for preventing relative vertical movement between a production tube and erosion-resistant rings in a blast joint, comprising:

an inside cone cylinder sized to fit the outside of the production tube;

threads on an external surface of the inside cone cylinder;

a frusto-conical face on an inside surface of the inside cone cylinder;

an outside cone cylinder sized to fit the outside of the inside cone cylinder;

threads on an internal surface of the outside cone cylinder shaped to mesh with the threads on the inside cone cylinder;

a frusto-conical face on an inside surface of the outside cone cylinder;

a plurality of slip segments radially inward from the outside cone cylinder, having inwardly facing teeth;

opposing frusto-conical faces on external surfaces of two ends of each slip segment, such faces aligning with the frusto-conical faces on the cone cylinders so that, when the cone cylinders are threaded together, the slip segments are driven radially inwardly, forcing the slip teeth into the production tube; and a circular leaf spring arranged radially inwardly from the slip segments so as to bias the slip segments radially outwardly.

* * * * *